United States Patent [19]

Hanna

[11] Patent Number: 4,846,447

[45] Date of Patent: Jul. 11, 1989

[54] ACTUATOR DEVICE FOR A TRIGGER OF AN AUTOMATIC NOZZLE OF A GASOLINE PUMP

[76] Inventor: Wayne Hanna, 817 Maine St., Bay Shore, N.Y. 11706

[21] Appl. No.: 195,030

[22] Filed: May 17, 1988

[51] Int. Cl.[4] ..... B65B 3/04

[52] U.S. Cl. ..... 267/182; 141/392; 251/90

[58] Field of Search ..... 251/89, 90; 141/391, 141/392, 98; 74/526; 267/158, 36.1, 182

[56] References Cited

U.S. PATENT DOCUMENTS

| | | | |
|---|---|---|---|
| 1,014,563 | 1/1912 | Bowden | 267/158 X |
| 4,176,695 | 12/1979 | Raske | 251/90 |
| 4,245,682 | 1/1981 | Agnew, Sr. | 251/90 |
| 4,287,736 | 9/1981 | Hadgis | 141/392 |
| 4,683,923 | 8/1987 | Harris | 251/90 |
| 4,690,182 | 9/1987 | Knaus | 141/392 |

*Primary Examiner*—Andres Kashnikow
*Assistant Examiner*—Matthew C. Graham
*Attorney, Agent, or Firm*—Michael I. Kroll

[57] ABSTRACT

An actuator device for a trigger operable within a housing of an automatic nozzle of a gasoline pump is provided and consists of a pair of jaws, each formed transversely onto an opposite end of a web of a predetermined length. The upper jaw fits over the housing while the lower jaw fits under the trigger when the trigger is pulled up for operation.

9 Claims, 1 Drawing Sheet

32
34
36
16
38
22
10
20
14
18
28
12
26
24
42
40
44

22
22'
10d
20
24
24'

22
10
20
28
26
24

22
10b
30
20
28
26
24

22
10a
20
24

22
10c
4
4
20
24

10c 10,10a,10b & 10d

ACTUATOR DEVICE FOR A TRIGGER OF AN AUTOMATIC NOZZLE OF A GASOLINE PUMP

BACKGROUND OF THE INVENTION

1. Field of the Invention

The instant invention relates generally to gasoline pumps and more specifically it relates to an actuator device for a trigger of an automatic nozzle of a gasoline pump.

2. Description of the Prior Art

Numerous gasoline pumps have been provided in prior art that are adapted to include pivotable regulator clips thereon for holding the triggers of the nozzles in operable positions so that the people using the pumps do not have to keep squeezing the triggers by hand. While these units may be suitable for the particular purpose to which they address, they would not be as suitable for the purposes of the present invention as heretofore described.

SUMMARY OF THE INVENTION

A primary object of the present invention is to provide an actuator device for a trigger of an automatic nozzle of a gasoline pump that will overcome the shortcomings of the prior art devices.

Another object is to provide an actuator device for a trigger of an automatic nozzle of a gasoline pump in which the device can be disposed between the housing and trigger of the nozzle for operation when the regulator clip is removed therefrom.

An additional object is to provide an actuator device for a trigger of an automatic nozzle of a gasoline pump in which the device can be fabricated into one of a variety of configurations being generally C-shaped to hold the trigger of the nozzle in its operable position.

A further object is to provide an actuator device for a trigger of an automatic nozzle of a gasoline pump that is simple and easy to use.

A still further object is to provide an actuator device for a trigger of an automatic nozzle of a gasoline pum that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 2A, 2B, 2C, 2D, 3, 4:
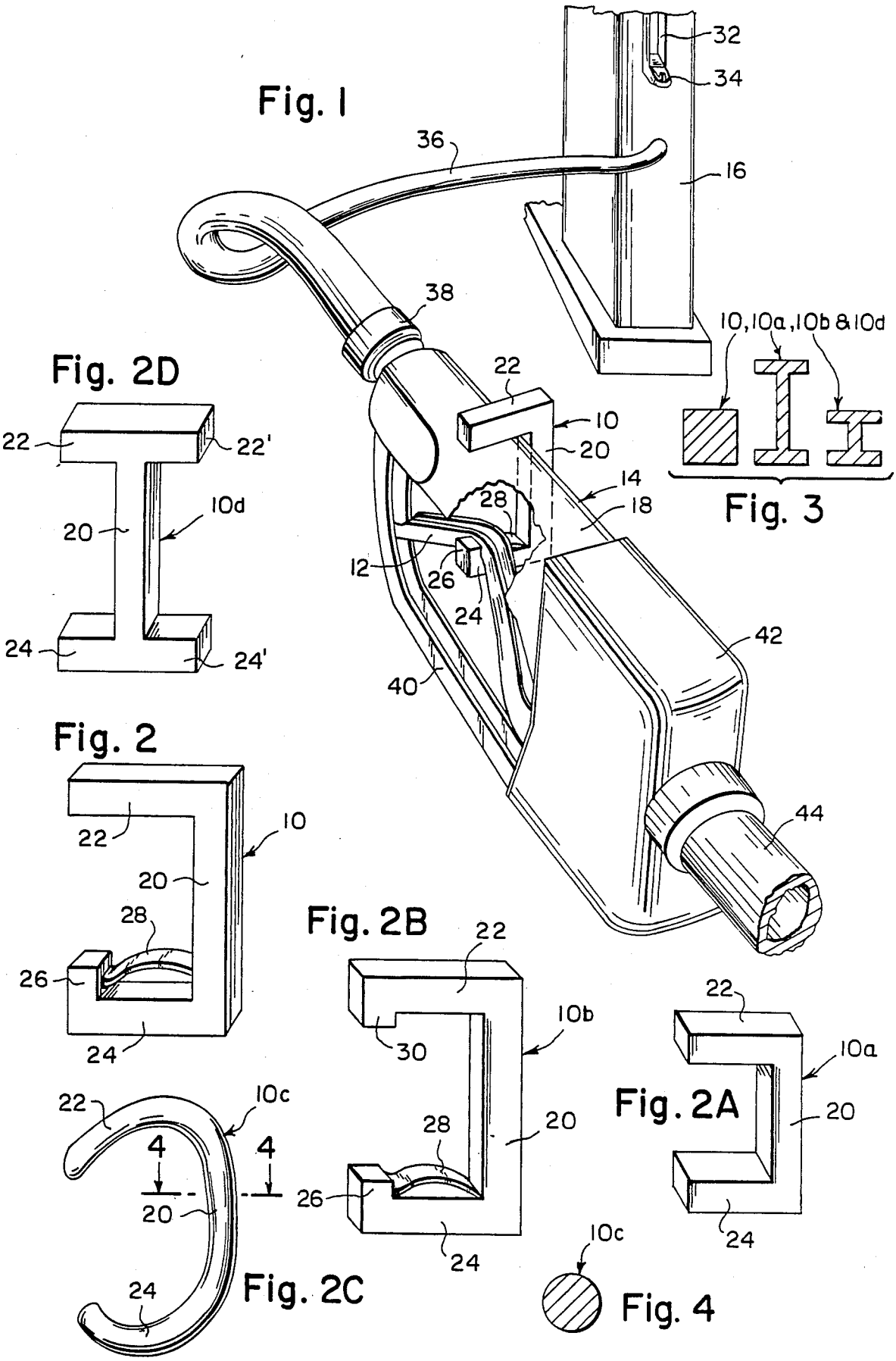
FIG. 1 is a perspective view with parts broken away of a gasoline pump with an automatic nozzle and the invention being applied thereto for operating the trigger thereof.
FIG. 2 is a perspective view of the invention.
FIG. 2A is a perspective view of a second modification of the invention.
FIG. 2B is perspective view of a third modification of the invention.
FIG. 2C is a perspective view of a fourth modification of the invention.
FIG. 2D is a perspective view of a fifth modification of the invention.
FIG. 3 is cross sectional views showing square, I-shaped and H-shaped configurations.
FIG. 4 is a cross sectional view as taken along line 4—4 in FIG. 2C showing a round configuration.

Turning now descriptively to the drawings, in which similar reference characters denote similar elements throughout the several views, FIG. 1 illustrates an actuator device 10*a* for a trigger 12 of an automatic nozzle 14 of a gasoline pump 16. The nozzle 14 has the trigger 12 operable within a housing 18.

The device 10, as best seen in FIG. 2, consists of a web 20 of a predetermined length and a pair of jaws 22 and 24. Each of the jaws are formed transversely onto an opposite end of the web 20 so that the upper jaw 22 can fit over the housing 18 while the lower jaw 24 can fit under the trigger 12 when the trigger is pulled up for operation. The lower jaw 24 further includes an upwardly extending finger 26 formed onto distal end thereof and a leaf spring 28 affixed between the finger 26 and the web 20 so that the finger 26 and the leaf springs 28 will firmly hold the trigger 12 thereon.

FIG. 2A shows a second modified device 10*a* being simple in structure wherein the lower jaw 24 does not includes the upwardly extending finger 26 and the leaf spring 28 is not utilized.

FIG. 2B shows a third modified device 10*b* wherein the upper jaw 22 further includes a downwardly extending finger 30 formed onto distal end thereof so that the finger 30 will prevent the upper jaw 22 from slipping off the housing 18.

As shown in FIG. 3, the transverse cross sections taken along any portion of the devices 10, 10*a* and 10*b* can be square, I-shaped or H-shaped while the devices are in a generally C-shaped box-like configuration. FIGS. 2C and 4 show a fourth modified device 10*c* wherein the transverse cross section taken along any portion thereof is round and the device 10*c* is in a generally C-shaped oval-like configuration.

FIG. 2D shows a fifth modified device 10*d* wherein the transverse cross section taken along any portion thereof can be square, I-shaped or H-shaped like in FIG. 3. The device 10*d* is in a generally I-shaped configuration in which each of the jaws 22 and 24 includes an extension piece 22' and 24' thus forming a T-shape at each opposite end of the web 20.

The gasoline pump 16 also includes a nozzle boot 32, a reset/on and off lever 34, a hose 36 and a coupling 38 to the housing 18 of the nozzle 14. A trigger guard 40, a fender guard 42 and a spout 44 are also provided on the nozzle 14. Any of the actuator devices 10, 10*a*, 10*b*, 10*c* and 10*d* can take the place of a removed regulator clip which is normally provided on the nozzle 14.

LIST OF REFERENCE NUMBERS

10—actuator device
10*a*—second modified device
10*b*—third modified device
10*c*—fourth modified device
10*d*—fifth modified device.
12—trigger
14—automatic nozzle
16—gasoline pump
18—housing
20—web
22'—upper jaw 22'—extension piece
24—lower jaw
24'—extension piece
26—upwardly extending finger
28—leaf spring
30—downardly extending finger
32—nozzle boot
34—reset/on and off lever
36—hose
38—coupling
40—trigger guard
42—fender guard
44—spout It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An actuator device for a trigger of an automatic nozzle of a gasoline pump, the nozzle having the trigger operable within a housing, said device comprising:

(a) a web being of a predetermined length; and (b) a pair of jaws, each of said jaws formed transversely onto an opposite end of said web so that said upper jaw can fit over the housing while said lower jaw can fit under the trigger when the trigger is pulled up for operation thereof, said lower jaw further including an upwardly extending finger formed onto distal end thereof and a leaf spring affixed between said finger and said web so that said finger and said leaf spring will firmly hold the trigger therefrom.

2. An actuator device as recited in claim 1, wherein said upper jaw further includes a downwardly extending finger formed onto distal end thereof so that said finger will prevent said upper jaw from slipping off the housing.

3. An actuator device as recited in claim 2, wherein transverse cross section taken along any portion thereof is square and said device is in a generally C-shaped box-like configuration.

4. An actuator device as recited in claim 2, wherein transverse cross section taken along any portion thereof is I-shaped and said device is in a generally C-shaped box-like configuration.

5. An actuator device as recited in claim 2, wherein transverse cross section taken along any portion thereof is H-shaped and said device is in a generally C-shaped box-like configuration.

6. An actuator device as recited in claim 1, wherein transverse cross section taken along any portion thereof is round and said device is in a generally C-shaped oval-like configuration.

7. An actuator device as recited in claim 1, wherein transverse cross section taken along any portion thereof is square and said device is in a generally I-shaped configuration in which each of said jaws includes an extension piece thus forming a T-like shape at each opposite end of said web.

8. An actuator device as recited in claim 1, wherein transverse cross section taken along any portion thereof is I-shaped and said evice is in a generally I-shaped configuration in which each of said jaws includes an extension piece thus forming a T-like shape at each opposite end of said web.

9. An actuator device as recited in claim 1, wherein transverse cross section taken along any portion thereof is H-shaped and said device is in a generally I-shaped configuration in which each of said jaws includes an extension piece thus forming a T-like shape at each opposite end of said web.

* * * * *